US005773771A

United States Patent [19]

Chatham

[11] Patent Number: 5,773,771

[45] Date of Patent: Jun. 30, 1998

[54] APPARATUS FOR PREVENTING UNINTENDED MOVEMENT OF ELEVATOR CAR

[76] Inventor: Charles Chatham, 429 N. 97 St., Wauwatosa, Wis. 53226

[21] Appl. No.: 692,808

[22] Filed: Jul. 30, 1996

[51] Int. Cl.[6] ..... B66B 1/36; B66B 1/00; B66B 1/34

[52] U.S. Cl. ..... 187/282; 187/288; 187/276; 187/302

[58] Field of Search ..... 187/276, 288, 187/282, 277, 285, 295, 299, 302

[56] References Cited

U.S. PATENT DOCUMENTS

| | | | |
|---|---|---|---|
| 4,015,689 | 4/1977 | Johnson | 187/62 |
| 5,228,537 | 7/1993 | Pfleger et al. | 187/8.5 |
| 5,583,326 | 12/1996 | Sors | 187/277 |

FOREIGN PATENT DOCUMENTS

| | | | |
|---|---|---|---|
| 4-144889 | 5/1992 | Japan | 187/288 |

OTHER PUBLICATIONS

Foelix, Heinz, Abstract of Application CH 00419085, Oct. 31,1988.

*Primary Examiner*—Robert Nappi
*Attorney, Agent, or Firm*—Skarsten Law Offices S.C.

[57] ABSTRACT

Apparatus for restricting motion of an elevator car includes bars or other stiff, elongated members, which are extended outwardly from opposing ends of the elevator car, when the car is positioned in a specified zone of vertical displacement, above the lower edge thereof The displacement zone may be on the order of twelve inches. An elevator control, such as an inspection bank mounted on top of the elevator car, is then operated to move the elevator car slightly downward, to the lower edge of the displacement zone, whereupon the elongated members are brought into solid contact with respective complementary supporting members, joined to opposing elevator guide rails. As the elongated members are extended, a switching arrangement, electrically coupled to the control, is simultaneously actuated to prevent movement of the elevator car above the displacement zone while the elongated members are in their extended mode.

13 Claims, 6 Drawing Sheets

APPARATUS FOR PREVENTING UNINTENDED MOVEMENT OF ELEVATOR CAR

BACKGROUND OF THE INVENTION

The invention disclosed and claimed herein generally pertains to apparatus for preventing unintended downward or upward movement of an elevator car or platform. More particularly, the invention pertains to apparatus of such type which can be readily actuated, when desired, to hold the elevator car at a substantially fixed level. Even more particularly, the invention pertains to apparatus of such type which is comparatively simple and inexpensive, and can be readily adapted for use with existing elevators and elevator controls.

It is anticipated that the invention will be particularly useful in connection with the class of elevators known commercially as hydraulic elevators, although the invention is by no means limited thereto. As is well known in the art, elevators of such type are raised and lowered by means of a hydraulic lift and/or power system which includes a piston and cylinder arrangement, and further includes hydraulic lines, valves, couplings, and fluid.

In the operation and use of a hydraulic elevator, it is frequently necessary to position the elevator car at some level above the bottom of the elevator shaft or "pit". This may be required, for example, to enable a worker to perform inspection, maintenance, or other tasks. If it is anticipated that the task will not require disassembly of the hydraulic power system, it is common practice to rely on such power to maintain the car at the raised level. However, such practice can be very hazardous. If a worker in the pit inadvertently trips over or otherwise ruptures a hydraulic line or other hydraulic system component, allowing the hydraulic fluid to rapidly escape, the elevator car will free fall. This is extremely dangerous, and serious and even fatal injuries have resulted therefrom.

Other work tasks routinely performed in a hydraulic elevator pit require disassembly of components of the hydraulic power system, so that fluid is necessarily released therefrom. Such tasks include, without limitation, packing replacement, fluid line repair and any other work that involves disconnecting the piston from the bottom of the elevator. Since tasks of this type require disablement of the hydraulic power systems, they cannot be performed until an elevator support structure has been constructed, in order to provide independent support for the elevator car. Such structures typically extend upwardly from the floor of the elevator shaft, and are formed of pipe stands or hardwood timbers. It is essential that these structures be properly and reliably constructed. Accordingly, substantial amounts of time, effort and care may be required therefor. Moreover, in such arrangements the space between the shaft floor and the bottom of the elevator car is generally limited by the maximum height of the elevator support structure. A further hazard may be created thereby, if the volume of the hydraulic fluid used in connection with the elevator is larger than the space beneath the elevator car. Under certain circumstances, an inadvertent break or rupture of the hydraulic fluid line can cause the space to rapidly fill with fluid. In the past, accidents of this type have created life-threatening situations for workers trapped in the pit.

SUMMARY OF THE INVENTION

The invention generally comprises means for selectively locking an elevator car against downward motion below a specified level, in combination with means for restricting upward travel of the car, from the specified level, to a very limited zone or range which may be on the order of inches. The invention further includes means for actuating the locking means and upward travel restricting means simultaneously, or in other coordinated relationship.

In a preferred embodiment, wherein the elevator car is positioned for movement with respect to a stationary guide rail system, and an electric circuit is provided for enabling an operator to control elevator car movement from the top of the car, the locking means includes bars or the like which are extendible outward from opposing ends of the underside of the car to engage complementary means located along the guide rail system. The travel restricting means comprises means for interrupting the electric control circuit to prevent the car from rising above the zone.

OBJECTS OF THE INVENTION

An object of the invention is to provide improved apparatus for selectively preventing an elevator car or other movable component from descending below a specified level along its vertical path of travel, for safety or other reasons.

Another object, is to provide apparatus of the above type, wherein the specified level can be located at virtually any desired position along the elevator path of travel.

Another object is to provide apparatus of the above type which additionally is able to limit displacement of the elevator car above the specified level to a very small zone, which may be on the order of inches.

Another object is to provide apparatus of the above type which can be quickly and easily actuated or released.

Another object is to provide apparatus of the above type which is comparatively simple and inexpensive.

Another object is to provide apparatus of the above type which can be readily installed for use with an existing elevator system, and is especially useful in connection with hydraulic elevators, although not limited thereto.

These and other objects of the invention will become more readily apparent from the ensuing specification, taken together with the accompanying drawings.

DETAILED DESCRIPTION OF THE PREFERRED EMBODIMENT

Figure 1:
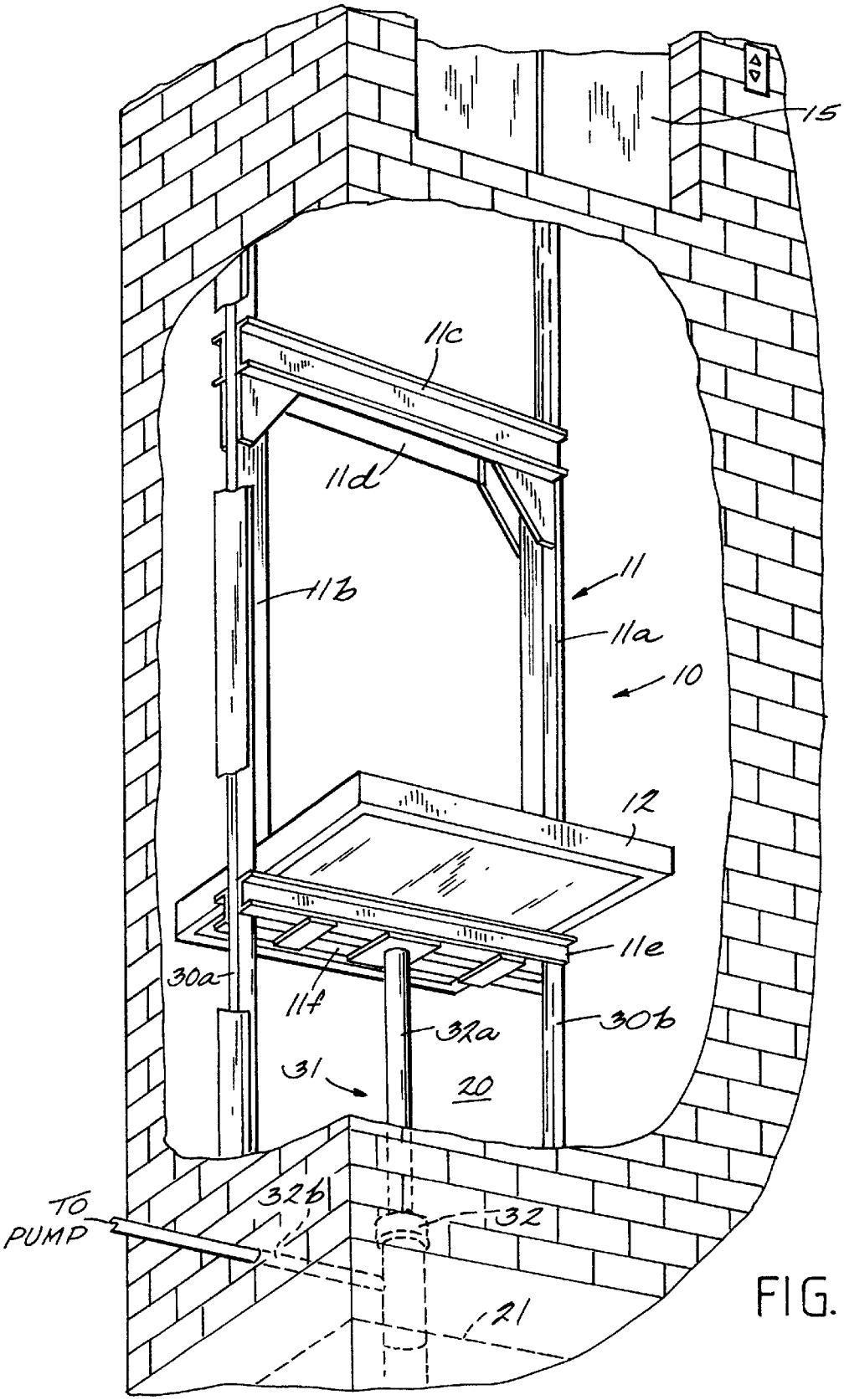
FIG. 1 is a perspective view, with a portion broken away, showing a conventional hydraulic elevator.
Figure 2:
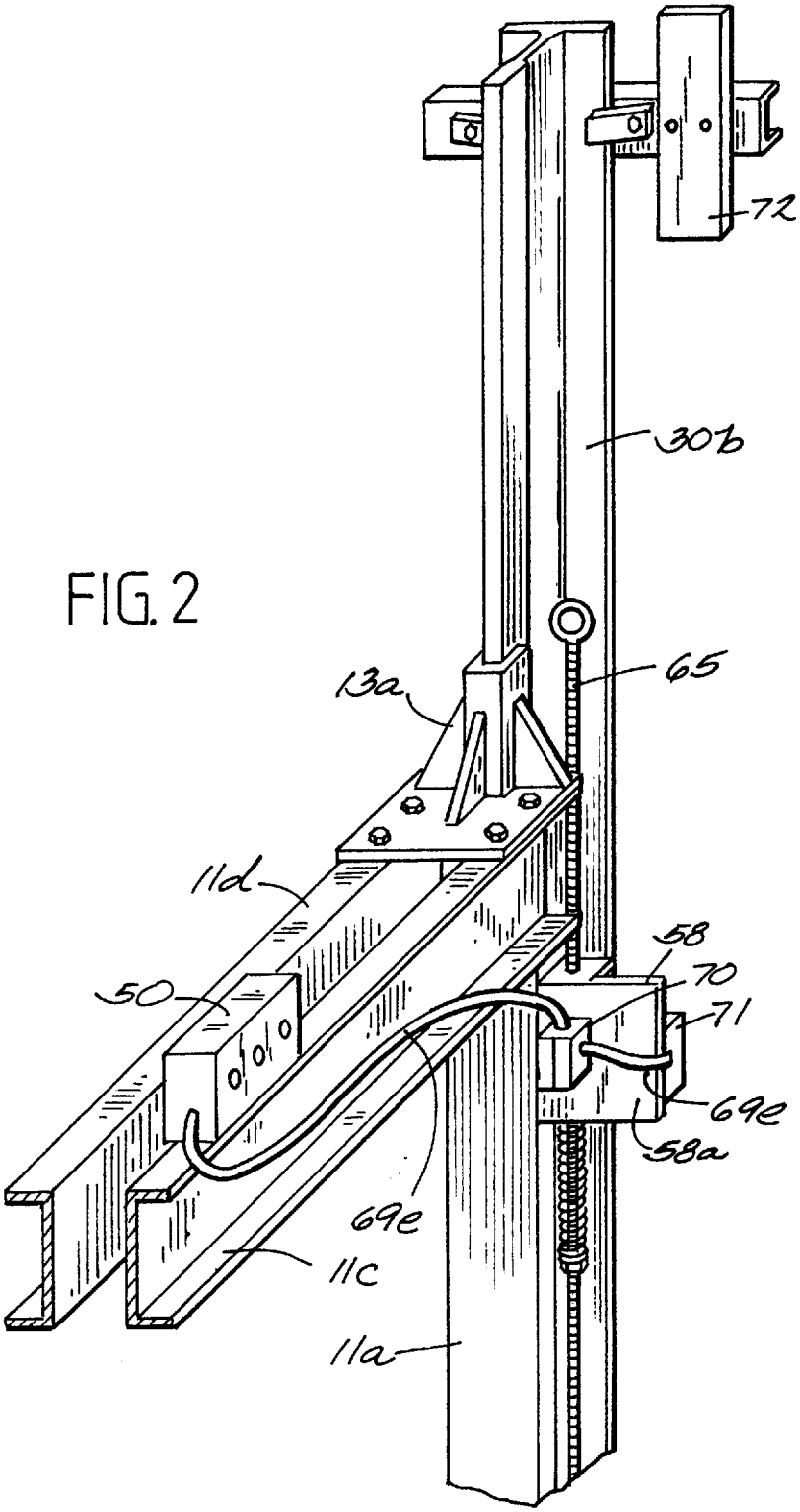
FIGS. 2 and 3 show respective portions of the elevator of FIG. 1 in greater detail, and also show components of an embodiment of the invention mounted thereon.
Figure 3:
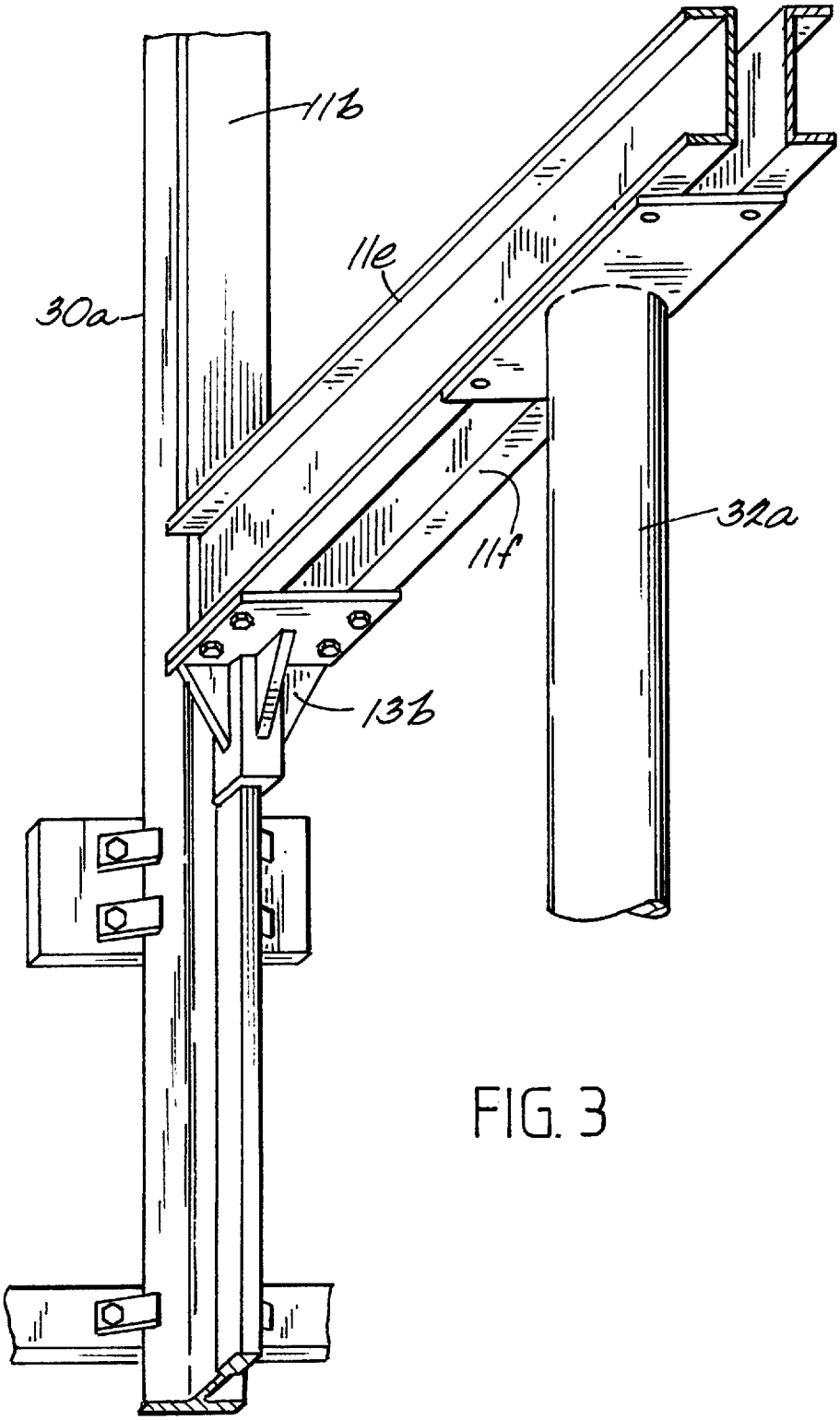

Referring to FIG. 1, there is shown a conventional hydraulic elevator 10 generally comprising a car sling 11, mounted for vertical movement along stationary, vertically oriented guide rails such as 30*a* and 30*b*. Hydraulic elevator 10 further comprises a floor or supporting platform 12, and sling 11 comprises side stiles 11*a* and 11*b*, a pair of top cross head members 11*c* and 11*d*, and a pair of bottom bolster channels 11*e* and 11*f*, which carry floor 12. The sling 11, floor 12 and sheet metal shrouding (not shown) are principal components of the vertically movable structure referred to herein as the elevator car. The shrouding is carried by the sling 11 and floor 12, and is positioned therearound to form a passenger enclosure, which is accessible through a door 15. It is to be understood that none of the drawings show the elevator passenger enclosure, which was intentionally left out in order to clearly show critical or essential elevator components and the embodiment of the invention. Roller guide assemblies, slide guide assemblies, or the like 13*a* and 13*b*, as best shown in FIGS. 2 and 3 respectively, are mounted to the top and bottom of car sling 11, i.e. to the top cross head members 11*c* and 11*d* and to the bottom bolster channels 11*e* and 11*f*, respectively, and engage guide rails 30*a* and 30*b*. The car sling 11 is thereby constrained to a vertical path of travel. The floor 12 is not shown in figures other than FIG. 1, to enhance illustration.

FIG. 1 further shows a hydraulic lift system 31 including a hydraulic cylinder or cylinders 32 positioned in floor 21 at the base or bottom of elevator shaft 20, each cylinder receiving a hydraulic piston 32*a* which acts against the bottom of car sling 11. Hydraulic fluid is moved into or out of cylinder 32 through a hydraulic line 32*b* as required, to drive piston 32 and car sling 11 upward or downward. Other components of a hydraulic lift system 31 for elevator 10, such as a pump and motor or other hydraulic actuator (not shown) are generally located in an adjoining machine control room (not shown).

Figure 6:
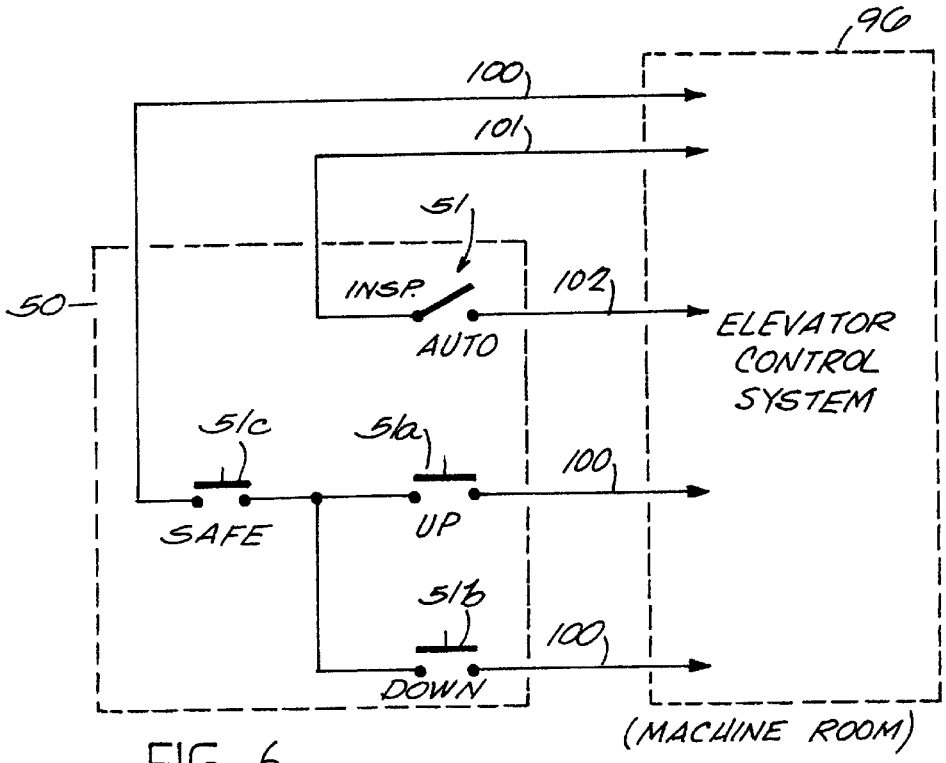
FIG. 6 PRIOR ART
FIG. 6 is a schematic viewing showing an inspection control bank for the elevator of FIG. 1 in accordance with the prior art.
Figure 7:
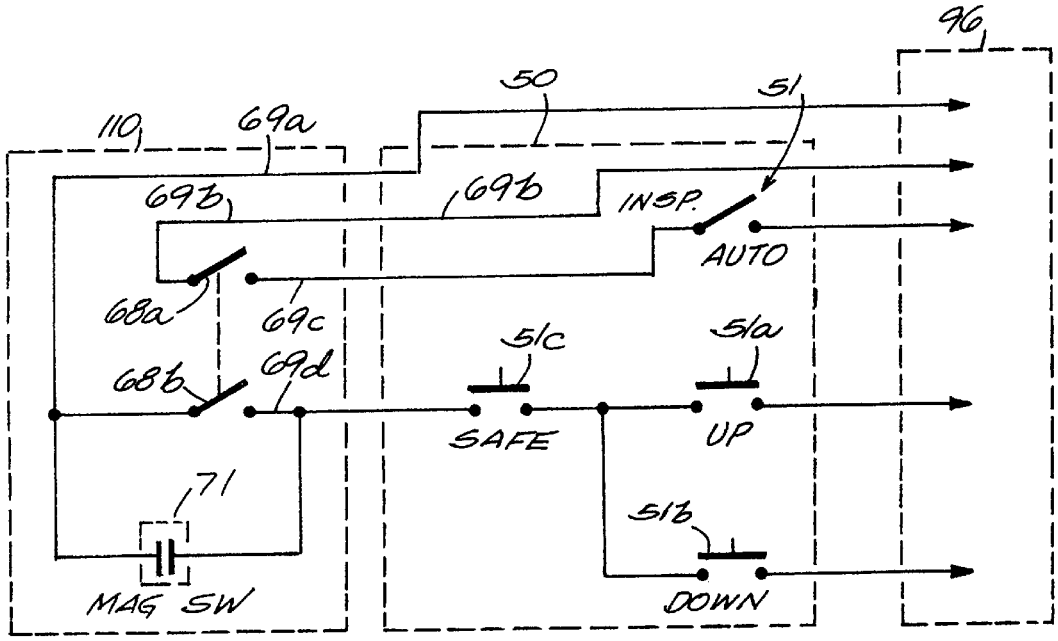
FIG. 7 is a schematic view showing the control bank of FIG. 6 adapted in accordance with the embodiment shown in FIGS. 2–6.

It is to be understood that both the hydraulic elevator 10 and the hydraulic system 31, as depicted in FIGS. 1–3, are well known in the art. Hydraulic elevator 10, in normal mode of operation, is controlled by an operator within the car, but not from a position on top of the car and sling 11. However, as further described hereinafter, certain inspection and other tasks must be performed by an operator positioned on top of the elevator car. Accordingly, a local elevator control 50, known in the art as an inspection control bank and described hereafter in connection with FIGS. 6 and 7, is placed on the elevator car top and is generally mounted to either of the cross head members 11*c* or 11*d*.

Figure 4:
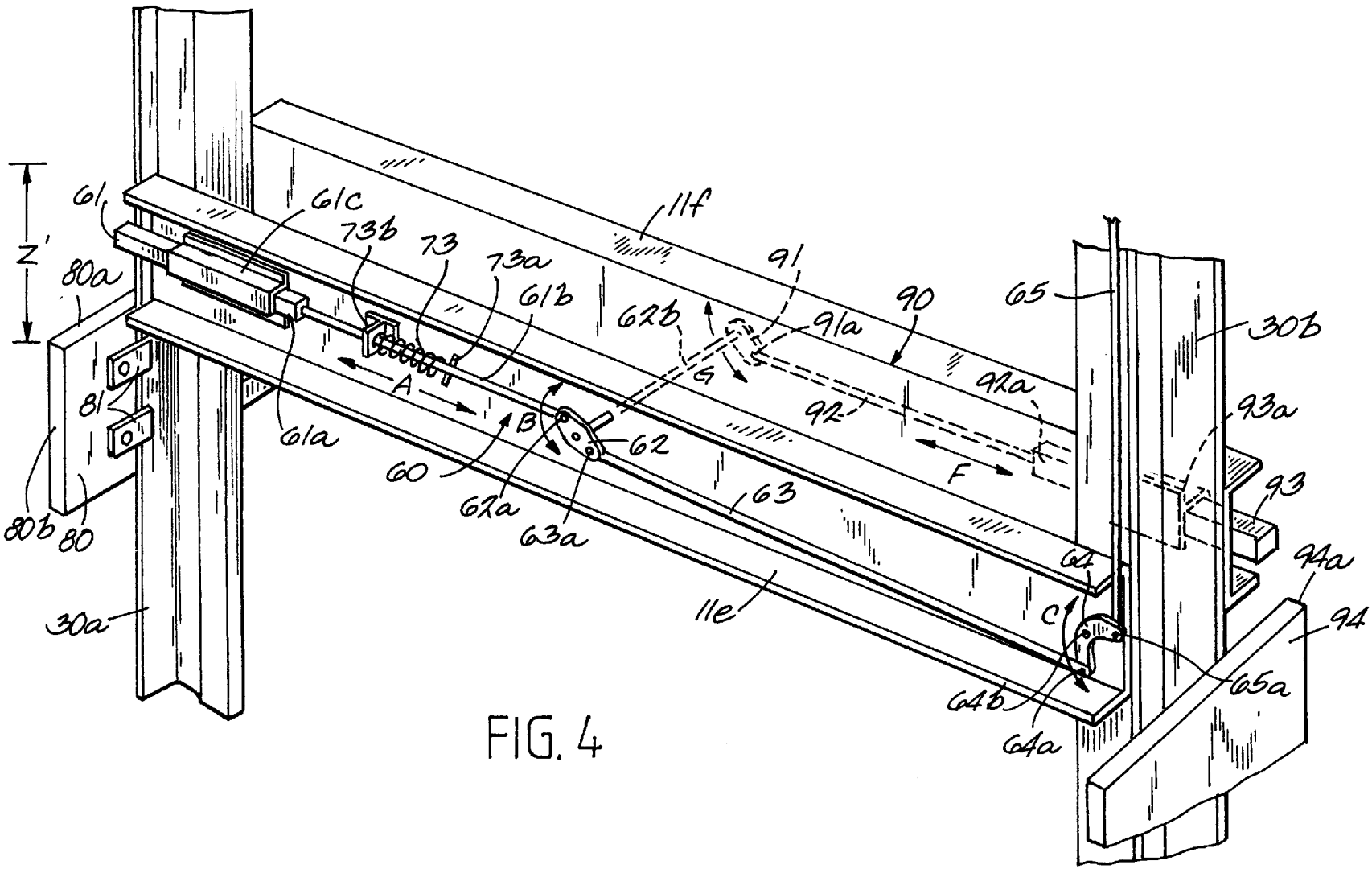
FIGS. 4–5 show different perspective views of the embodiment of the invention mounted upon the elevator shown in FIG. 1.

Referring to FIG. 4, there is shown a mechanism 60, comprising an arrangement of mechanical components, and further comprising a portion of the embodiment of the invention. Mechanism 60 includes a bar 61, which is securely joined to a rod 61*b* at its rightward end with a pin 61*a*, as viewed in FIG. 1. Bar 61 and rod 61*b* are mounted to bolster channel 11*e* by means of a horizontal guidance system comprised of brackets or other supporting members 61*c*, so that bar 61 and rod 61*b* can reciprocate in unison with respect to bolster channel 11*e*, in the directions indicated by double headed arrow A.

FIG. 4 further shows the end of rod 61*b* opposite bar 61 tied to a pivoting member 62, such as by means of a pin 62*a*. Member 62 is mounted for pivotal or rotational movement by means of a shaft 62*b*. Shaft 62*b* is of such length that it passes through both bolster channels 11*e* and 11*f* and extends outward from the side thereof opposite to the side shown in FIG. 4. It is to be understood that pivoting member 62 is fixed to shaft 62*b*, so that rotation of member 62 causes shaft 62*b* to rotate in unison. Shaft 62*b* may be supported for such movement by extending it through a hole formed in bolster channels 11*e* and 11*f* having a diameter which is slightly larger than the shaft 62*b* diameter. Alternatively, shaft 62*b* could be supported for rotation by bearings (not shown). Member 62 can pivot clockwise or counterclockwise, as shown in FIG. 4, by double-headed arrow B. An end of a rod 63 is also joined to pivoting member 62 by pin 63*a*, and the opposing end of rod 63 is joined to a second pivoting member 64, by a pin 64*a*.

Figure 5:
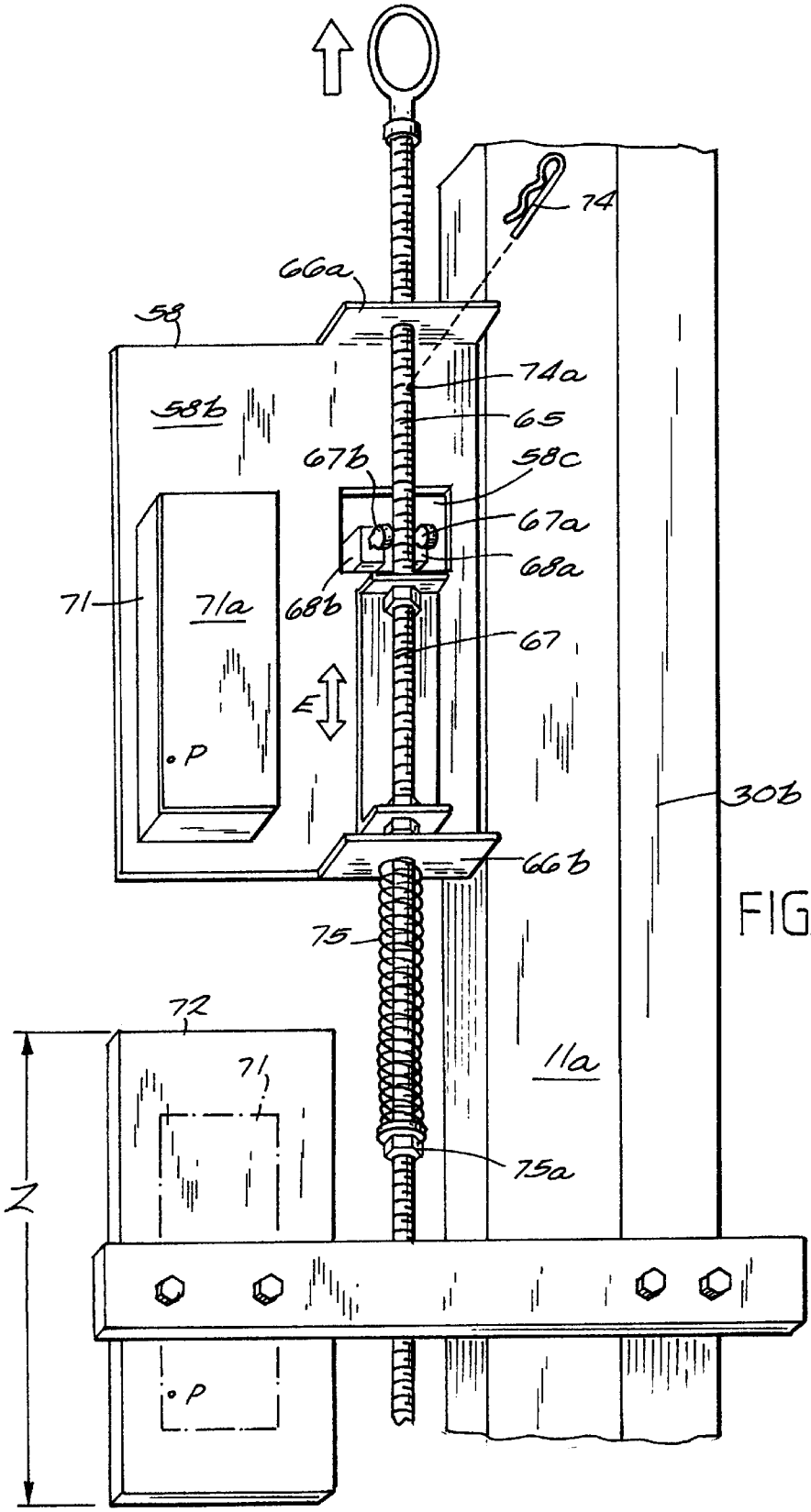

Member 64 can pivot around pin 64*b*, as shown by double headed arrow C. The lower end of a lift rod 65 is joined to pivoting member 64 by a pin 65*a*. The lower portion of lift rod 65 is shown in FIG. 4 and the upper portion thereof is shown in FIGS. 2 and 5. FIG. 5 shows a cam 67 joined to the upper portion of rod 65, and vertically movable therewith, to respectively engage switch elements 67*a* and 67*b*, of respective micro switches 68*a* and 68*b*, when rod 65 is moved along its vertical path of travel. More particularly, switch elements 67*a* and 67*b* are operated to turn switches 68*a* and 68*b* off when rod 65 and cam 67 are moved upwardly, and to turn switches 68*a* and 68*b* on when rod 65 and cam 67 are moved downwardly. Switches 68*a* and 68*b* are respectively connected to inspection bank 50 through electrical leads 69*a*, 69*b*, 69*c* and 69*d*, and are provided to interact with inspection bank 50 as described hereinafter in connection with FIG. 7. Switches 68*a* and 68*b* are usefully contained in a housing 70, as viewed in FIG. 2. Leads 69*a–d* are shown schematically in FIG. 7, and are collectively included in cable 69*e*, shown in FIG. 2, which extends between housing 70 and inspection bank 50.

Cam 67 and switches 68*a* and 68*b* are mounted upon a mounting plate 58, attached to side stile 11*a* of sling 11. Housing 70, containing the switches, is mounted upon plate 58 on side 58*a* thereof, as shown by FIG. 2. FIG. 5 shows cam 67 mounted on the opposing side of plate 58, i.e., side 58*b* thereof. The switch elements 67*a* and 67*b* extend through an aperture 58*c* formed through the mounting plate, for engagement with the cam 67.

Referring further to FIG. 5, there is shown a magnetic switch 71 mounted on side 58*b* of plate 58, next to cam 67. Face 71*a* of switch 71 extends outwardly from plate 58. Magnetic switch 71 is generally open or in an open mode as it moves with car sling 11 along the vertical path of travel thereof However, to close switch 71, a sheet of conductive material, such as a steel plate 72, is joined to guide rail 30*b* at a selected vertical level. More specifically, conductive plate 72 is positioned so that face 71*a* of magnetic switch 71 may move into very close proximity with plate 72. When the point P shown on face 71*a* is within a zone Z defined by the position of plate 72, the plate 72 and certain operative components in switch 71 (not shown) will be closely spaced apart, causing switch 71 to close. The zone Z usefully has a length on the order of twelve inches. Magnetic switch 71, which is well known in the art, is likewise connected to inspection bank 50, through electrically conductive leads 69*a* and 69*d*, thus effectively placing the magnetic switch in parallel with the micro switch 68*b*, and interacting with inspection bank 50 as described hereinafter in connection with FIG. 7.

By suitable design, point P on switch 71 will be at the lower end of zone Z when the lower edge of bar 61 is at the lower end of a zone Z', which is equal in length to the zone Z. Thus, conductive plate 72 is joined to guide rail 30*b* so that plate 72 causes switch 71 to close only when the elevator car is positioned so that bar 61 is within the zone Z'. Otherwise, the switch 71 will be open. As shown in FIG. 4 and described hereinafter, the lower edge of the zone Z'coincides with the upper edge of a steel plate 80 bolted to guide rail 30*a*.

Vertical movement of rod 65, in addition to operating micro switches 68*a* and 68*b* shown in FIG. 5, serves to operate the mechanism 60 shown in FIG. 4 and including rods 61*b*, 63, and 65, bar 61 and pivoting members 62 and 64. As shown in FIG. 5, rod 65 passes through guides 66*a* and 66*b*, respectively attached to the top and bottom of plate 58, which constrain rod 65 to vertical movement.

When a force is applied to move rod 65 upward, member 64 is pivoted in a counterclockwise direction, causing rod 63 to move rightwardly, as viewed in FIG. 4. Member 62 is thereby pivoted in a counter-clockwise direction, so that rod 61*b* and bar 61 are moved leftward, to an extended position. Extending bar 61 and rod 61*b* compresses spring 73 positioned around rod 61*b*, wherein one end of spring 73 is constrained by a pin or locking device 73*a*, which is attached to rod 61*b*, and the other end of spring 73 is constrained by a bracket 73*b*, which has a guide hole for rod 61*b*, and is attached securely to bolster channel 11*e*. Additionally, upward movement of rod 65 compresses a spring 75, positioned around rod 65, as viewed in FIG. 5. Spring 75 is constrained on one end by a pin or locking device 75*a*, attached to rod 65, and the opposing end is constrained by lower guide 66*b*. In a useful embodiment, rod 65 is moved upwardly manually, as indicated in FIG. 5 by arrow E. To maintain the bar 61 in its extended position, a pin 74 is thrust through a hole 74*a* in the end of rod 65, after the hole 74*a* has been moved above top guide 66*a*, to place the rod 65 in its upward position. The pin 74 then acts against the guide 66*a* to hold rod 65 upwardly. Both springs 73 and 75 act to release the mechanism 60 from its activated position, and thereby cause bar 61 to move rightward to its retracted position, upon removal of pin 74 from hole 74*a*.

Referring further to FIG. 4, there is shown bar 61 extending beyond the adjacent guide rail 30*a*. There is further shown a plate 80, of very heavy steel stock, solidly joined to the guide rail 30*a* such as by means of bolts 81. Plate 80 is attached to the guide rail 30*a* so that the upper edge 80*a* of the plate coincides with the lower edge of the zone Z'. Moreover, the plate 80 is of such dimension that the side edge 80*b* of the plate 80 extends beyond guide rail 30*a* such that it lies in the vertical path of the bar 61 in its extended position. Thus, when bar 61 is located above plate 80 and is in its extended position, elevator car sling 11 can only descend until bar 61 is brought into contact with the upper edge 80*a* of plate 80. Accordingly, bar 61 acts to prevent the bottom of car sling 11 from descending below a selected level, determined by the location at which plate 80 is attached to guide rail 30*a*.

Referring again to FIG. 4, there is shown a mechanical arrangement 90, which comprises a further component of the embodiment of the invention. Arrangement 90 generally includes a pivoting member 91, a rod 92 having an end joined to member 91 by means of a pin 91*a*, and a bar 93 securely joined by means of a pin 92*a* to the opposite end of rod 92. Bar 93 is similar or identical to bar 61, and bar 93 and rod 92 are mounted to bolster channel 11*f* by means of brackets or the like 93*a*, which are similar or identical to brackets 61*c*. Thus bar 93 and rod 92 can reciprocate in unison with respect to bolster channel 11*f*, in the directions indicated by the double-headed arrow F, in response to pivoting movement of member 91.

Referring further to FIG. 5, there is shown pivoting member 91 joined to the shaft 62*b*, and rotatable therewith in clockwise and counterclockwise directions, as indicated by double-headed arrow G. Thus, mechanical arrangement 90 is configured so that as rod 65 is moved upward to extend bar 61 outward, past guide rail 30*a*, rotational power is simultaneously transferred through pivoting member 62, shaft 62*b*, and pivoting member 91. Such rotational power acts to extend bar 93 outward, in a direction that is opposite that of the bar 61 movement and past the guide rail 30*b*. A steel plate 94, similar or identical to plate 80, is joined to guide rail 30*b*, that is, so that it lies in the vertical path of the bar 93 in its extended position. Plate 94 and bar 93 are respectively positioned so that when both bars 61 and 93 are extended outward, and car sling 11 is descending, the lower edges of the bars will simultaneously contact the upper edges 80*a* and 94*a* of their respective plates 80 and 94. Elevator car sling 11 will thereby be firmly held in position, and prevented from descending below the selected level.

It will be readily apparent that when rod 65 is moved downward, the bars 61 and 93 will simultaneously be retracted, that is, moved rightward and leftward, respectively, as viewed in FIG. 4. Referring once again to FIG. 5, such action may be simply achieved by removing pin 74. As springs 73 and 75 expand from their compressed positions, as described above, in addition to retracting bar 61, rotational power is delivered through shaft 62*b* and pivoting member 91, to draw bar 93 into its retracted position. While not shown, the retracted positions of bars 61 and 93 are respectively selected so that, when retracted, the bars will not interfere with the free vertical travel of elevator car sling 11.

Referring to FIG. 6, there is shown car top inspection bank 50, comprising a conventional set of controls for enabling an operator to locally control elevator movements from a position on the top of the car sling 11. Inspection bank 50 is connected to an elevator control system 96, comprising a network of control relays or other elements, such as are well known in the art. The control system may be located in the machine control room. Inspection bank 50 includes a mode selection switch 51, for selecting either inspection or automatic mode of elevator operation. When the selection switch 51 is moved to the inspection mode of operation, electrical current is transferred from line 101 to line 102. In response, the elevator control 96 eliminates power from line 100, effectively disabling the up button 51*a*, down button 51*b* and safe button 51*c* of inspection bank 50. However, when the switch 51 is moved to the inspection mode of operation, electrical current is removed from line 102, whereby the elevator control room 96 transfers power to line 100. This now allows elevator control by means of inspection bank 50, by use of the buttons 51*a*, 51*b*, and 51*c*. The inspection bank allows elevator operation from a position on top of the car, to perform tasks such as elevator maintenance, inspections, or cleaning. Such operation typically requires the use of two hands, for safety reasons. The possibility of accidental movement of the elevator, for example, resulting from an object inadvertently depressing a single button, is thereby greatly reduced. Accordingly, to transfer electrical current from line 100 to either the up button 51*a* or the down button 51*b*, the safe button 51*c* must first be depressed with one hand. A second hand must then depress either the up button 51*a*, or the down button 51*b*, in order to close a circuit to transfer the current from line 100 back to the elevator control system 96, and thereby move the elevator car upward or downward.

Referring to FIG. 7, there is shown a switching arrangement 110, comprising the micro switches 68*a* and 68*b* and magnetic switch 71 described above, interconnected to inspection bank 50. Such connections may be made with comparative ease, by means of electrical leads 69*a*, 69*b*, 69*c*, and 69*d*, respectively. More particularly, switch 68*a* is coupled in series with the mode selection switch 51, and switch 68*b* is coupled in series with safe button 51*c*. Magnetic switch 71 is coupled in parallel with micro switch 68*b*.

The embodiment of the invention described above generally comprises mechanical arrangements 60 and 90, and switching arrangement 110. The operation of the embodiment, comprising an elevator motion restraining device, may now be readily understood. When rod 65 is in a downward position, bars 61 and 93 are retracted and switches 68*a* and 68*b* are both closed. Accordingly, the restraining device does not affect the normal elevator movement or the conventional controls thereof, including inspection bank 50.

When it is desired to activate the motion restraining device of the invention, in order to lock the elevator in place at the selected level, an operator on top of the elevator operates switch 51 to select the inspection mode of operation. Controls 51*a*, 51*b*, and 51*c* are then employed to move the elevator car sling 11 to an actuation position, that is, so that the bar 61 is within the vertical zone Z'. In such position, the lower edges of the bars 61 and 93 will be above the upper edges of steel plates 80 and 94, respectively. However, the clearance therebetween will be no greater than the zone Z' dimension. Accordingly, magnetic switch 71 will be within zone Z, so that switch 71 will be in its closed state. For the convenience of the operator, respective marks may be placed on the car sling 11 and on either guide rail, 30*a* or 30*b*, which will be in alignment when the car is in such actuation position.

After such position has been reached, the operator moves rod 65 upward. Bars 61 and 93 are thereby extended outward, as described above, and switches 68*a* and 68*b* are opened. However, even though switch 68*b* is now open, magnetic switch 71 is closed. Accordingly, line 69*d* remains active, and the down control button 51*b* can be operated in conjunction with safe button 51*c*, to lower the elevator by the slight amount required to bring the bars 61 and 93 into rigid engagement with plates 80 and 94, respectively. Elevator car sling 11 will thereby be prevented from further downward motion, even if the associated hydraulic system should fail.

With the motion restraining device of the invention activated, as described above, the elevator car will be prevented from rising by more than a displacement equal to the zone Z. For example, if the up button 51*a* and the safe button 51*c* are inadvertently operated while the bars 61 and 93 are supported by respective plates 80 and 94, point P on magnetic switch 71 will move out of zone Z after the elevator car has traveled the distance Z. Magnetic switch contact 71 will thereupon open, deactivating the up button 51*a* and preventing any further upward movement of the car sling 11. This prevents possible accidents, and damage to structure in the elevator shaft which would encounter the outwardly extending bars, if they moved upward a significant distance. Obviously, numerous modifications and variations of the present invention are possible in light of the above teachings. It is therefore to be understood that within the scope of the disclosed concept, the invention may be practiced otherwise than as specifically described.

What is claimed is:

1. Apparatus for preventing unintended movement of an elevator car wherein an electric circuit is provided for selectively moving the car, and said apparatus comprises:

means for selectively locking said car against downward motion below a selected level;

travel control means for enabling operation of said circuit to controllably move said car to any selected position within a specified zone of displacement extending above said selected level, and for preventing movement of said car beyond said zone; and means for actuating said locking means and said travel control means in selected coordinated relationship with each other.

2. Apparatus for preventing unintended movement of an elevator car, wherein an electric circuit is provided for selectively moving said car, said apparatus comprising:

means for selectively locking said car against downward motion below a specified level:

switching means coupled to said electric circuit for selectively enabling and disabling use of said electric circuit to move said car;

means responsive to the vertical position of a specified point on said elevator car for operating said switching means to enable use of said circuit when a specified point lies within a specified vertical range, and for otherwise disabling use of said circuit, and to limit upward travel of said car to a specified zone of displacement above said specified level, said specified range being equal in length to said zone of displacement and means for actuating said locking means and said switching means in selected coordinated relationship with each other.

3. The apparatus of claim 2 wherein:

said switching means comprises a magnetic switch, and said operating means comprises a sheet of conductive material positioned to cause said magnetic switch to close only when said specified point is within said vertical range, said rang being no greater than on the order of twelve inches.

4. The apparatus of claim 3 wherein:

said switching means further comprises means for interrupting power transmission through said electric circuit to prevent upward movement of said car, when said magnetic switch is not closed.

5. The apparatus of claim 2 wherein said elevator car is positioned for movement with respect to stationary support structure, and wherein:

said locking means comprises means extendible outward from opposing ends of said car to engage corresponding complementary support members located along said support structure.

6. The apparatus of claim 5 wherein:

said locking means and said switching means are actuated simultaneously.

7. The apparatus of claim 6 wherein:

said elevator car comprises a component of a hydraulic elevator system.

8. Apparatus for preventing unintended movement of an elevator car positioned for vertical movement between first and second guide rails, and provided with an electric control circuit operable to vertically move the car, said apparatus comprising:

first and second elongated members extendible outward from opposing ends of said car to engage corresponding complementary support members, respectively joined to said first and second guide rails;

first and second drive mechanisms attached to said first and second elongated members, respectively, and positioned on opposite sides of said car;

a rotatable member joined to said first and second drive mechanisms and rotatable in a first direction to operate said drive mechanisms to simultaneously extend said first and second elongated members, and rotatable in the opposite direction to operate said drive mechanisms to simultaneously retract said first and second elongated members:

switching means coupled to said control circuit and actuatable to enable said control circuit to move said elevator only within a specified zone of displacement above said level; and means for actuating said rotatable member and said switching means together, when said car is in said specified zone.

9. The apparatus of claim 8 wherein said control circuit includes a path for transmitting electrical power to vertically move said elevator, and wherein:

said switching means comprises means for allowing power transmission through said path when said elevator car is within said displacement zone, and for interrupting said transmission if said elevator car moves upwardly beyond said displacement zone, to prevent further upward movement of said elevator car.

10. The apparatus of claim 9 wherein said switching means comprises:

a first switch coupled into said power transmission path, and opened by actuation of said switching means;

a second switch coupled to provide an alternative power transmission path when said first switch is open; and means for closing said second switch only when said elevator car is within said specified zone of displacement zone.

11. The apparatus of claim 10 wherein:

said first switch comprises a micro switch;

said second switch comprises a magnetic switch coupled in parallel with said micro switch; and said means for closing said second switch comprises a sheet of conductive material joined to one of said guide rails and positioned to close said magnetic switch only when said elevator car is within said displacement zone.

12. The apparatus of claim 11 wherein:

said control circuit comprises an inspection bank control mounted on the top of said elevator car.

13. The apparatus of claim 10 wherein:

said actuating means comprises means for simultaneously opening said first switch, and transferring rotary power to said rotatable member to extend said first and second elongated members outward.

* * * * *